US005822844A

United States Patent [19]

Mento

[11] Patent Number: 5,822,844

[45] Date of Patent: Oct. 20, 1998

[54] ELASTIC CLOSURE COMPONENT

[76] Inventor: Daniel F. Mento, 120 Beechwood Ter., Pottstown, Pa. 19465-8610

[21] Appl. No.: 834,722

[22] Filed: Apr. 1, 1997

[51] Int. Cl.[6] ..... A43C 11/22

[52] U.S. Cl. ..... 24/573.1; 24/713.1

[58] Field of Search ..... 24/573.1, 713.1, 24/713, 712; 36/50.1, 51

[56] References Cited

U.S. PATENT DOCUMENTS

| | | | |
|---|---|---|---|
| 1,898,225 | 2/1933 | Szabo . | |
| 2,004,702 | 6/1935 | Luttmann, Jr. | 24/713.1 |
| 2,270,702 | 1/1942 | Getmansky | 24/573.1 X |
| 2,580,843 | 1/1952 | Sam | 24/713.1 X |
| 2,824,351 | 2/1958 | Webb . | |
| 3,382,546 | 5/1968 | Palmay et al. | 24/114.7 |
| 3,636,594 | 1/1972 | Faivre | 24/713.1 X |
| 4,210,983 | 7/1980 | Green | 24/713.1 X |
| 5,239,732 | 8/1993 | Steven | 24/713 X |
| 5,295,315 | 3/1994 | Osawa et al. | 24/712 X |

FOREIGN PATENT DOCUMENTS

| | | | |
|---|---|---|---|
| 638521 | 11/1936 | Germany | 24/712 |

*Primary Examiner*—James R. Brittain

[57] ABSTRACT

A fastener replacing the laces in a shoe. The fastener consists of an elastic substance having an intersection, with a plurality of appendages protruding outward, with a gusset and a half semicircle located at the end of the appendages.

5 Claims, 1 Drawing Sheet

ELASTIC CLOSURE COMPONENT

BACKGROUND OF THE INVENTION

1. Field of the Invention

This invention relates to elastic fasteners, specifically, fastening or gripping means to eyelets of shoes replacing ordinary shoe laces.

2. Description of the Related Art

The use of one piece elastic cords or bands as shoe laces with integral barbs or enlargements on the ends of the cords or bands for anchoring the cords or bands against the back of the shoe eyelets is old and well known. However, considerable difficulty may be encountered when trying to insert the T-shaped anchoring means into a shoe eyelet due to the 90 degree angle between the T-shaped anchoring means and the single band. The 90 degree angle does not lend itself to being easily inserted through a shoe eyelet. The T-shaped anchoring means is attached to a single band at 90 degrees. This design promotes direct foot energies onto the T-shaped anchoring means forcing the T-shape into a U-shape thus pulling the anchoring means out of the shoe eyelet once the shoe is in use by the wearer.

A single elastic band/cord design lacks sufficient shock absorbing surface for the wearer's comfort and to prevent direct energies from pulling the anchoring means out of the shoe eyelet.

To install the single band fasteners, each anchoring means is inserted in opposite laterally facing eyelet holes. This method assists in the failure of the anchoring means since any stress of the single band will directly effect the anchoring means forcing a pull out of the T-shaped anchoring means.

(a) U.S. Pat. No. 3,382,546 to Ilona Bosznay Palmay and Steven Kish (1968), Is an example of the single band T-shaped design. Difficulty is encounter when trying to insert the T-shaped anchoring means and their extensions through eyelet holes, since the T-shaped anchoring means and their extensions create a 90 degree angle when attached to the single band support. The 90 degree angle resists insertion and needs to be overcome before the rest of the anchoring means can be pulled through the eyelet hole.

(b) Foot pressure on a single band design is concentrated on only two anchoring means per single band component. Since the body of the band is attached at a right angle to the anchoring means U.S. Pat. No. 3,382,546 to Ilona Bosznay Palmay and Steven Kish (1968), have the wearer's foot pressures acting directly onto only two anchoring means per individual component which will increase fatigue on the anchoring means and facilitate the anchoring means being pulled out of the eyelet hole more easily under foot pressure.

(c) U.S. Pat. No. 3,382,546 to Ilona Bosznay Palmay and Steven Kish (1968), demonstrates the form in which the anchoring means is attached to the band at 90 degrees or is T-shaped. When the T-shaped anchoring means and its extension press against the interior walls of a shoe eyelet hole the pressure causes the T-shaped anchoring means and its extension to bow and pull outward through the eyelet hole rendering the anchoring means useless for the wearer of the shoes.

(d) U.S. Pat. No. 3,382,546 to Ilona Bosznay Palmay and Steven Kish (1968), uses a single elastic band support for each pair of anchoring means. This has been the conventional method of elastic cords or bands; support comes from a single elastic band component anchored into two opposite eyelet holes. The single band design lacks sufficient shock absorbing surface for the comfort of the wearer and to prevent the anchoring means from pulling out.

(e) U.S. Pat. No. 3,382,546 to Ilona Bosznay Palmay and Steven Kish (1968), demonstrates installation of the single band fastener by inserting each anchoring means in opposite laterally facing eyelet holes. Forces exerted, from walking or running, on the single band fasteners will be transferred directly to the anchoring means causing fatigue or even a pull out of the T-shaped anchoring means to occur.

BRIEF SUMMARY OF THE INVENTION

The reader will see that the elastic fastener of this invention supplies an improved level of comfort over prior art and the conventional shoe lace. Due to its unique intersection and appendage design that absorbs pressure through the elastic material from which it was constructed. The resilient intersection and appendage design also reduces wear to the anchoring means located at the end of its appendages.

The anchoring means attached at the end of the appendage having on one side a gusset positioned at a obtuse angle to the appendage located at the other side of the gusset is a half semicircle positioned at an acute angle to the appendage. The obtuse angle of the gusset allows for effortless insertion through a small opening such as may be found in a shoe eyelet and grasping for pulling of such ends through the eyelets. When the anchoring means is passed through an eyelet opening to the appendage then pulling the appendage in a outward direction, the obtuse angle of the gusset with the acute angle of the half semicircle curves to form a conical shaped obstruction preventing pullout of the anchoring means from a shoe eyelet. The conical shaped obstruction has superior holding power over the prior arts traditional T-shaped anchoring means which will bow and pull out of a shoe eyelet with little force. Such a closure component is comfortable, due to the stretchable material which expands during walking or running. Moreover, the resilient and stretchable closure component of the present invention, fits snugly against the upper contours of the foot to provide a resilient form of comfortable support. At the same time, novel construction of the present invention will allow the shoe to be slipped on or off the foot, without undoing, or otherwise altering the closure component.

OBJECTS AND ADVANTAGES OF THE INVENTION

It is accordingly a principle object of this invention to provide a plurality of seamless elastic closure components in the form of a intersection of resilient material, with a plurality of appendages protruding outward from the intersection with a anchoring means attached at the ends of the appendages. One side of the anchoring means is attached to the appendage at an obtuse angle in the form of a flat gusset. The obtuse angle will facilitate effortless insertion of the gusset through a small opening such as may be found in a shoe eyelet and grasping for pulling of the anchoring means through the shoe eyelets. The other part of the anchoring means consists of a half semicircle adjoining the gusset positioned at an acute angle to the appendage. The acute angle assists in the insertion of the half semicircle. When the half semicircle and the gusset are passed from the outside in through an eyelet opening up to the appendage then with the appendage pulled in a outward direction the acute angle of the half semicircle resists pullout and assists with the obtuse angle of the gusset in the formation of a conical shaped obstruction preventing pullout of the anchoring means from the shoe eyelet.

(a) A further object of this invention is to provide a closure component with an intersection that centralizes foot pressure for equal distribution to its appendages during walking or running. This increases comfort and lessens the daily fatigue to the multiple anchoring means.

(b) A still further object of this invention is to provide a gusset positioned at an obtuse angle from the appendage. The obtuse angle allows for effortless insertion of the gusset through a small opening such as may be found in a shoe eyelet and grasping for pulling of such ends through the eyelets of a shoe. Once in place the gussets obtuse angle assists in the convolution of the gusset assisting in the formation of the conical shaped obstruction.

(c) A still further object of this invention is to provide an anchoring means comprised of a gusset at an obtuse angle and a half semicircle at an acute angle. Once implemented it becomes an anchor by forming a conical shaped obstruction supplying sufficient resistance to the interior walls of the eyelet hole as to prevent the pull out from the eyelet hole when in use (d) Another object of this invention is to provide an improved elastic shoe closure component for spanning the gap between a plurality of eyelets which together with other similar elastic closure components when individually fitted to extend between other eyelets of that shoe replace the ordinary shoelace to provide an elastic reticulated support system to the wearer's foot and allows the shoe to be slipped on or off the foot, without undoing, or otherwise altering the closure component. Such a closure component is comfortable, due to the stretchable material which expands during walking or running and fits snugly against the upper contours of the foot to provide a resilient form of comfortable support.

(e) The preferred method of installing this invention is to insert the appendage and anchoring means diagonal to each other. This method of installation will protect the anchoring means from a direct pull out from the shoe eyelet and assist in an elastic reticulated support across the shoe vamp.

(f) A still further objective of this invention is to provide a new, novel, durable, inexpensive and still attractive resilient closure component made from natural or synthetic elastic substances in various colors which can be manufactured using traditional die press, punch press, or casting technologies.

These and other objects and advantages of this invention will become more apparent as the description is given and the features of novelty which characterize this invention will be pointed out with particularity in the claims annexed to and forming a part of this specification.

BRIEF DESCRIPTION OF THE SEVERAL VIEWS OF THE DRAWING

To the accomplishment of the foregoing and related ends, the invention, then, comprises the features herein-after fully described and particularly pointed out in the claims, the following description and the annexed drawing setting forth in detail a certain illustrative embodiment of the invention, this being indicative, however, of but one of the various ways in which the principles of the invention may be employed.

Drawing Figures

DETAILED DESCRIPTION OF THE INVENTION

Figure 1:
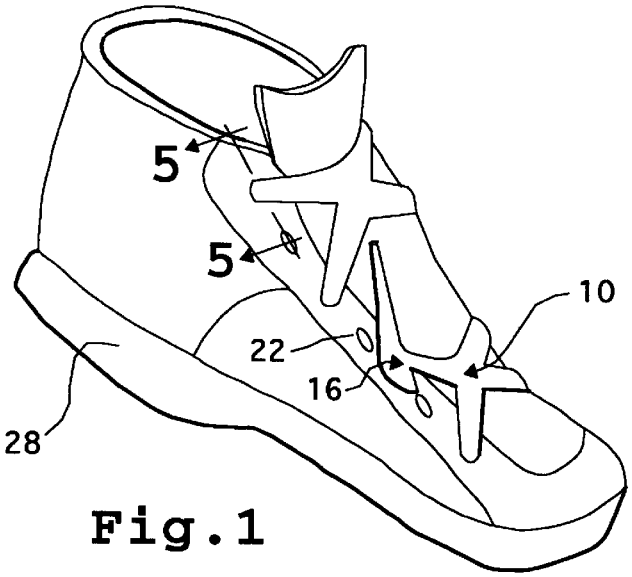
FIG. 1 is a perspective view of a shoe of conventional type with a plurality of elastic closure components constructed in accordance with this invention shown extending between multiple pairs of shoe eyelets.
Figure 2:
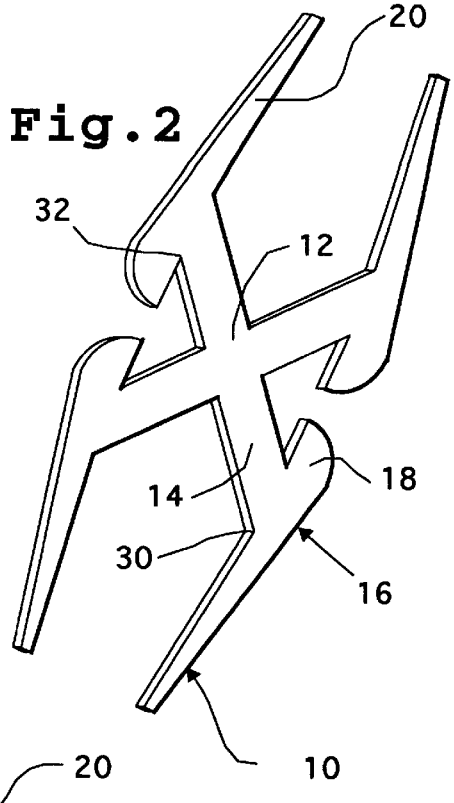
FIG. 2 is an enlarged perspective view of one of the elastic closure components of FIG. 1.
Figure 3:
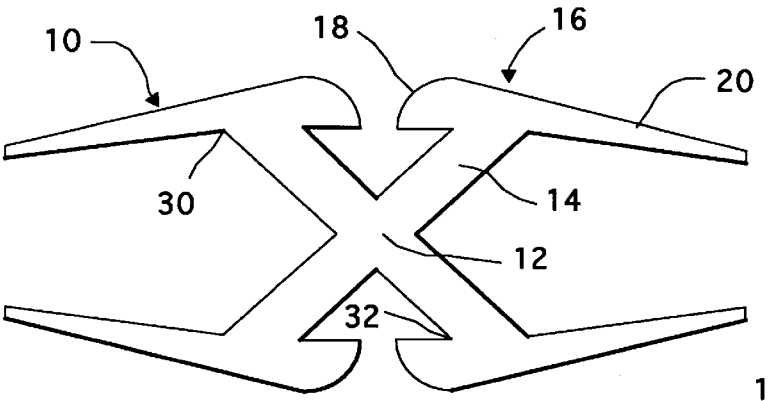
FIG. 3 is a bottom plan view of the elastic closure component.
Figure 4:
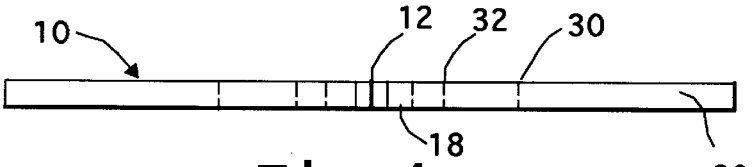
FIG. 4 is a side elevation view of the elastic closure component.

Referring now in detail to the drawings, a preferred form of an elastic closure component is generally indicated at 10 made of a suitable natural or synthetic rubber or rubber-like material and comprises of an intersection 12 with appendages 14 projecting outward from the intersection 12 with integral anchoring means 16 preferably in the form of a gusset 20 positioned at an obtuse angle 30 and a half semicircle 18 positioned at an acute angle 32 at the end of the appendage 14. The intersection 12 may be any width desired, and may be of any thickness desired, it is preferred that the intersection 12 be relativity short for extension between pairs of shoe eyelets 22. When the elastic closure component 10 is properly positioned through pairs of eyelets 22 of a shoe of conventional type FIG. 1, and when pulling the appendage 14 in a outward direction the acute angle 32 of the half semicircle 18 resists pullout and causes the incurvation of the half semicircle 18 moreover the obtuse angle 30 causes the gusset 20 to convolute, collectively the half semicircle 18 and the gusset 20 form the anchoring means 16 which assumes a conical shaped obstruction 26 FIG. 5 against the inner surface of the eyelet hole 24 with no discomfort to the wearer.

OPERATION—FIGS. 1–5

To facilitate insertion of the anchoring means 16 through shoe eyelets 22 the free end of the gusset 20 may be inserted from the outside through a shoe eyelet 22 for pulling and grasping of the anchoring means 16 through the eyelet 22. Then pulling the appendage 14 in a outward direction, the acute angle 32 of the half semicircle 18 resists pullout and causes the incurvation of the half semicircle 18. Moreover, the obtuse angle 30 causes the gusset 20 to convolute, collectively the half semicircle 18 and the gusset 20 form the anchoring means 16 which assumes a conical shaped obstruction 26 FIG. 5 against the inner surface of the eyelet hole 24 with no discomfort to the wearer while preventing pullout of the anchoring means from the shoe eyelet 22. The other anchoring means from the same elastic closure component 10 is preferably inserted diagonal to the opposing eyelet. This method is repeated when inserting the remaining anchoring means of the same elastic closure component 10 FIG. 1.

The elastic closure component 10, although easy to assemble, is difficult to remove but may be left in the shoe when putting them on or taking them off due to the resiliency of the spanning members which expand and contract with each step allowing the wear's foot to flex and of course no tying of the laces is required. This makes them ideal for shoes of children or those of the elderly; moreover, they are equally suited for adults' shoes, and are especially useful for high top sneakers that have a great many eyelets which ordinarily require a considerable amount of time to lace.

Figure 5:
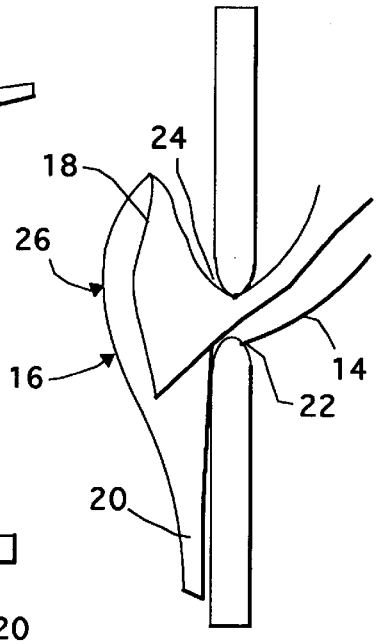
FIG. 5 is a vertical section of a shoe tab and eyelet hole with the anchoring means forming a conical shaped obstruction preventing pullout from a shoe eyelet.

When properly installed, the anchoring means 16 are concealed by the shoe and are of no discomfort to the wearer due to the resiliency of the material used and the manner in which the anchoring means 16 will assume a conical shaped obstruction 26 against the inner surface of the shoe eyelet 24 FIG. 5.

I claim:

1. An elastic closure component formed of a natural or synthetic elastic substance comprising an intersection of resilient material having a plurality of appendages protruding outward from said intersection with a gusset positioned at an obtuse angle to each said appendage adjoined to a half semicircle attached at an acute angle, from each said appendage.

2. The elastic closure component set forth in claim 1 wherein said obtuse angle will allow for effortless insertion of said gusset through a small opening such as may be found in a shoe eyelet and grasping for pulling of such ends through the eyelets.

3. The elastic closure component set forth in claim 1 wherein said acute angle will allow for effortless insertion of said half semicircle through a small opening such as may be found in a shoe eyelet.

4. The elastic closure component set forth in claim 1 wherein said gusset and said half semicircle are passed through an eyelet up to said appendage then said appendage is pulled in a outward direction, said acute angle of said half semicircle resists pullout and causes the incurvation of said half semicircle, said obtuse angle of said gusset assist in the convolution of said gusset and said half semicircle to complete the conical shape obstruction that supplies resistance to the walls of the eyelet as to prevent pull out from the eyelet when in use.

5. The elastic closure component set forth in claim 1 wherein said intersection provides elastic support which diffuses pressure to the wearer, lessens fatigue to said conical shape obstruction and provides a reticulated support system to the wearer when the elastic closure component is in use.

* * * * *